US011686170B2

(12) United States Patent
AlMannai et al.

(10) Patent No.: US 11,686,170 B2
(45) Date of Patent: Jun. 27, 2023

(54) EXPANDING A TUBULAR IN A WELLBORE

(71) Applicant: Saudi Arabian Oil Company, Dhahran (SA)

(72) Inventors: Abdulrahman N. AlMannai, Dhahran (SA); Nawaf D. Otaibi, Khobar (SA); Muath A. Radhwan, Abqaiq (SA); Kanwal B. Singh Khalsa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 98 days.

(21) Appl. No.: 17/342,868

(22) Filed: Jun. 9, 2021

(65) Prior Publication Data

US 2022/0397012 A1 Dec. 15, 2022

(51) Int. Cl.
*E21B 29/10* (2006.01)

(52) U.S. Cl.
CPC ..... *E21B 29/10* (2013.01)

(58) Field of Classification Search
CPC ..... E21B 29/10; E21B 29/00
See application file for complete search history.

(56) References Cited

U.S. PATENT DOCUMENTS 1,725,298 A * 8/1929 Rowland ..... E21B 29/10 175/335
3,795,035 A 3/1974 Pogonowski
6,142,230 A * 11/2000 Smalley ..... E21B 29/10 166/207
7,017,670 B2 3/2006 Hazel
7,121,351 B2 * 10/2006 Luke ..... E21B 29/10 166/207
7,156,182 B2 1/2007 Lynde et al.
7,383,889 B2 * 6/2008 Ring ..... E21B 43/105 166/212
7,422,068 B2 * 9/2008 Lynde ..... E21B 43/103 166/242.6
7,533,731 B2 * 5/2009 Corre ..... E21B 43/105 166/207
10,450,846 B2 * 10/2019 Jabs ..... E21B 43/108
2009/0229835 A1 9/2009 Filippov
2013/0140022 A1 * 6/2013 Leighton ..... E21B 29/10 166/212
2021/0198965 A1 * 7/2021 Al-Mousa ..... E21B 29/10

FOREIGN PATENT DOCUMENTS

CA 2664521 4/2007

* cited by examiner

*Primary Examiner* — Taras P Bemko
(74) *Attorney, Agent, or Firm* — Fish & Richardson P.C.

(57) ABSTRACT

A downhole tool includes a top sub-assembly that couples to a downhole conveyance and a housing. The housing includes a bore that extends through the housing from the top sub-assembly to a downhole end of the housing opposite the uphole end, and a plurality of compartments fluidly coupled to the bore. The downhole end of the housing including a tapered portion. At least one of the plurality of compartments includes at least one piston configured to extend away from the housing to forcibly expand at least a portion of a wellbore tubular based at least in part on a fluid pressure in the at least one compartment. The tool includes at least one hydraulic swage coupled to the housing and configured to expand to forcibly expand at least the portion of the wellbore tubular based at least in part on a fluid pressure in the bore.

22 Claims, 8 Drawing Sheets

EXPANDING A TUBULAR IN A WELLBORE

TECHNICAL FIELD

This disclosure relates to expanding a tubular in a wellbore and, more particularly, expanding a tubular in a wellbore with a downhole tool.

BACKGROUND

Tubing or casing collapse occurs in a wellbore when subjected to excessively high external pressure. This collapse may cause well accessibility issues, especially for workover operations (for example, killing and securing with downhole plugs).

SUMMARY

This disclosure describes a downhole tool for expanding a tubular in a wellbore.

In an example implementation, a downhole tool includes a top sub-assembly configured to couple to a downhole conveyance and a housing coupled to the top sub-assembly at an uphole end of the housing. The housing includes a bore that extends through the housing from at least near the top sub-assembly to a downhole end of the housing opposite the uphole end, the downhole end of the housing including a tapered portion; and a plurality of compartments fluidly coupled to the bore, at least one of the plurality of compartments including at least one piston configured to extend away from the housing to forcibly expand at least a portion of a wellbore tubular based at least in part on a fluid pressure in the at least one compartment; and at least one hydraulic swage coupled to the housing and configured to expand to forcibly expand at least the portion of the wellbore tubular based at least in part on a fluid pressure in the bore.

In an aspect combinable with the example implementation, the plurality of compartments include a first compartment positioned adjacent the tapered portion and a second compartment positioned between the first compartment and the top sub-assembly.

In another aspect combinable with any of the previous aspects, the first compartment includes a first external dimension and the second compartment includes a second external dimension larger than the first external dimension.

In another aspect combinable with any of the previous aspects, the first and second external dimensions are diameters.

In another aspect combinable with any of the previous aspects, the at least one hydraulic swage is coupled to the housing between the second compartment and the top sub-assembly.

In another aspect combinable with any of the previous aspects, the at least one hydraulic swage includes an unexpanded dimension larger than the second external dimension.

In another aspect combinable with any of the previous aspects, the plurality of compartment further includes a third compartment positioned between the second compartment and the top sub-assembly.

In another aspect combinable with any of the previous aspects, the third compartment includes a third external dimension larger than the second external dimension.

In another aspect combinable with any of the previous aspects, the at least one hydraulic swage is coupled to the housing between the third compartment and the top sub-assembly.

In another aspect combinable with any of the previous aspects, the at least one hydraulic swage includes an unexpanded dimension larger than the third external dimension.

In another aspect combinable with any of the previous aspects, each of the plurality of compartments includes at least one piston configured to extend away from the housing based at least in part on the fluid pressure in the at least one compartment.

In another aspect combinable with any of the previous aspects, the at least one piston includes a plurality of pistons positioned about an external perimeter of the at least one compartment.

In another example implementation, a method for expanding a wellbore tubular includes running a downhole tool on a downhole conveyance into a tubular within a wellbore, the downhole conveyance coupled to a top sub-assembly of the downhole tool; positioning the downhole tool adjacent an at least partially collapsed portion of the tubular within the wellbore; circulating a fluid to the downhole tool to hydraulically activate a compartment of a housing of the downhole tool to extend at least one piston from the compartment away from the housing toward the at least partially collapsed portion of the tubular; based on the at least one piston from the compartment extending away from the housing, forcibly expanding the at least partially collapsed portion of the tubular; moving the downhole tool downhole at least partly into the expanded portion of the tubular; and circulating the fluid to the downhole tool to hydraulically activate a swage of the downhole tool to further expand the at least partially collapsed portion of the tubular.

In an aspect combinable with the example implementation, the compartment includes a first compartment.

Another aspect combinable with any of the previous aspects further includes subsequent to forcibly expanding the at least partially collapsed portion of the tubular with the at least one piston of the first compartment, moving the downhole tool downhole at least partly into the expanded portion of the tubular.

Another aspect combinable with any of the previous aspects further includes circulating the fluid to the downhole tool to hydraulically activate a second compartment of the housing of the downhole tool to extend at least one piston from the second compartment away from the housing toward the at least partially collapsed portion of the tubular.

Another aspect combinable with any of the previous aspects further includes, based on the at least one piston from the second compartment extending away from the housing, further forcibly expanding the at least partially collapsed portion of the tubular.

In another aspect combinable with any of the previous aspects, the first compartment includes a first external dimension and the second compartment includes a second external dimension larger than the first external dimension.

In another aspect combinable with any of the previous aspects, circulating the fluid to the downhole tool to hydraulically activate the swage of the downhole tool further expand the at least partially collapsed portion of the tubular occurs subsequent to further forcibly expanding the at least partially collapsed portion of the tubular with the at least one piston of the second compartment.

Another aspect combinable with any of the previous aspects further includes subsequent to further forcibly expanding the at least partially collapsed portion of the tubular with the at least one piston of the second compartment, moving the downhole tool downhole further into the expanded portion of the tubular.

Another aspect combinable with any of the previous aspects further includes circulating the fluid to the downhole tool to hydraulically activate a third compartment of the housing of the downhole tool to extend at least one piston from the third compartment away from the housing toward the at least partially collapsed portion of the tubular.

Another aspect combinable with any of the previous aspects further includes, based on the at least one piston from the third compartment extending away from the housing, further forcibly expanding the at least partially collapsed portion of the tubular.

In another aspect combinable with any of the previous aspects, circulating the fluid to the downhole tool to hydraulically activate the swage of the downhole tool further expand the at least partially collapsed portion of the tubular occurs subsequent to further forcibly expanding the at least partially collapsed portion of the tubular with the at least one piston of the third compartment.

In another aspect combinable with any of the previous aspects, positioning the downhole tool adjacent the at least partially collapsed portion of the tubular within the wellbore includes positioning a tapered portion of the housing into the at least partially collapsed portion of the tubular within the wellbore; and based on the positioning, at least partially radially centering the downhole tool within the tubular.

In another aspect combinable with any of the previous aspects, extending the at least one piston from the compartment away from the housing toward the at least partially collapsed portion of the tubular includes extending a plurality of pistons positioned around a perimeter of the compartment away from the housing toward the at least partially collapsed portion of the tubular.

In another aspect combinable with any of the previous aspects, further expanding the at least partially collapsed portion of the tubular with the hydraulically activated swage includes smoothing or flattening the at least partially collapsed portion of the tubular.

Another aspect combinable with any of the previous aspects further includes circulating a heated fluid to the at least partially collapsed portion of the tubular within the wellbore prior to or concurrently with running the downhole tool on the downhole conveyance into the tubular within the wellbore.

In another example implementation, a wellbore tubular expansion system includes a segmented body that includes a fluid pathway that extends along a centerline of the body from a first end of the body towards a second end of the body, the fluid pathway configured to fluidly coupled to a wellbore conveyance, the segmented body including a plurality of fluidly coupled segments, each of the fluidly coupled segment having at least one member configured to move away from the centerline of the body in response to a first increase in fluid pressure in the fluid pathway to deform a wellbore tubular; and a swage attached to or formed with the segmented body and fluidly coupled with the fluid pathway. the swage configured to expand in response to the first increase or a second increase in fluid pressure in the fluid pathway to deform the wellbore tubular.

An aspect combinable with the example implementation includes a conical member affixed at the second end of the body.

In another aspect combinable with any of the previous aspects, the plurality of fluidly coupled segments are fluidly coupled together through the fluid pathway.

Implementations of a downhole tool according to the present disclosure may include one or more of the following features. For example, the downhole tool may operate to expand a completely collapsed tubular within a wellbore. As another example, the downhole tool may operate to expand a collapsed tubular within a wellbore without requiring jarring, which might not be possible in certain scenarios such as a collapsed tubular within a wellbore at or near a terranean surface. As yet another example, a downhole tool according to the present disclosure may operate to open a collapsed tubular so as to result in capitalization of existing hydrocarbon recovery assets instead of suspension or abandonment of such assets. As another example, a downhole tool according to the present disclosure may be operable to expand even a slightly collapsed tubular under any circumstance.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
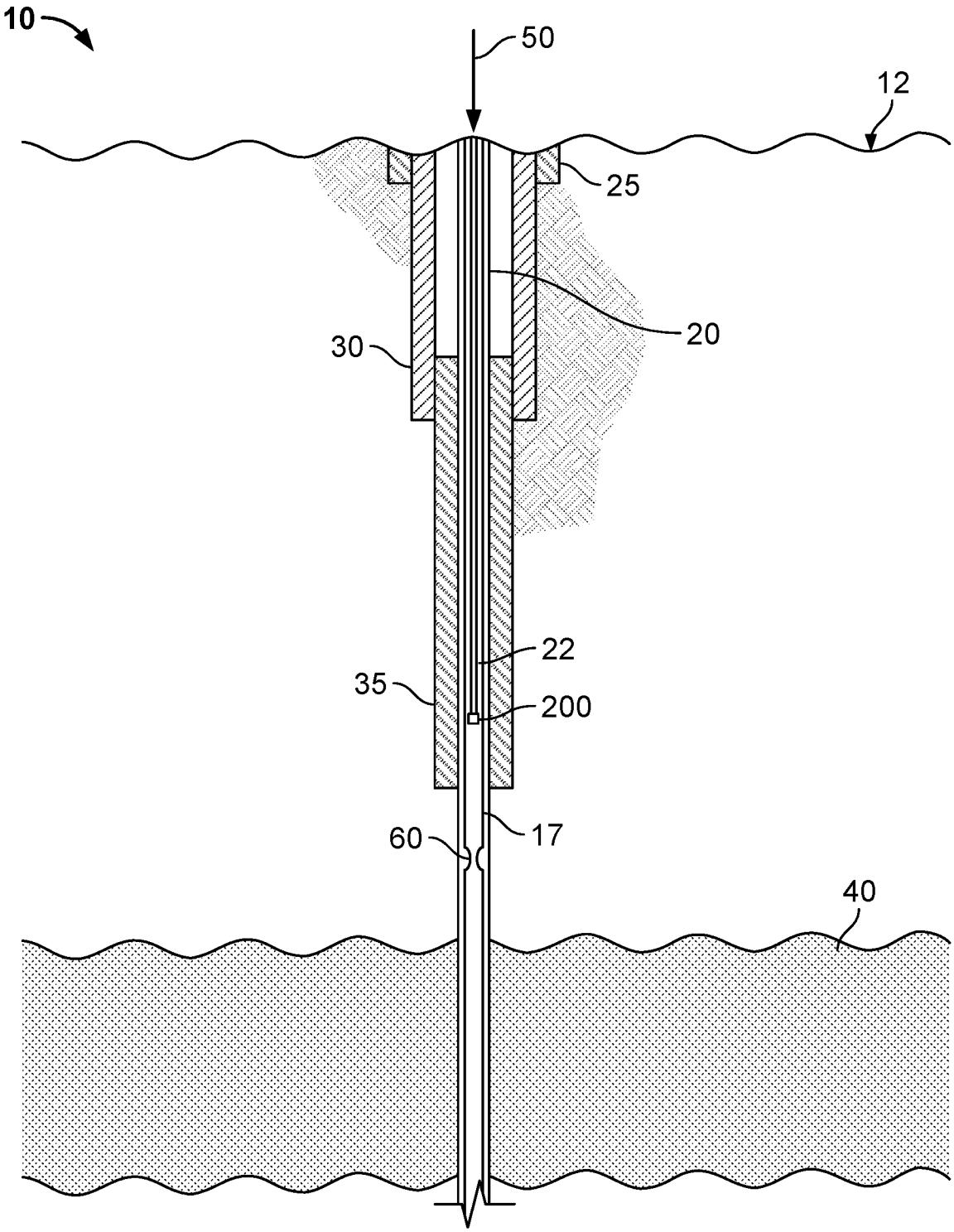
FIG. 1 is a schematic diagram of an example system that includes a downhole tool according to the present disclosure.

FIG. 1 is a schematic diagram of an example wellbore system 10 including a downhole tool 200. Generally, FIG. 1 illustrates a portion of one embodiment of a wellbore system 10 according to the present disclosure in which the downhole tool 200 may be run into a wellbore 20 and activated when the tool 200 reaches a particular location of a wellbore tubular 17 (or simply, tubular 17) within the wellbore 20. As shown in FIG. 1, the particular location may be a portion 60 of the tubular 17 that is at least partially collapsed (for example, partially collapsed tubular portion 60). In some aspects, the damaged portion 60 may block or restrict the wellbore 20 and needs to be opened to allow further downhole operations within the wellbore 20.

The downhole tool 200 (as explained in more detail later) includes one or more extension members, such as pistons, that may be hydraulically activated (sequentially or in parallel) to deform the partially collapsed tubular portion 60 back into at or near its original cross-section shape (for example, circular or close to circular). In some aspects, the one or more extension members may be positioned in multiple compartments of the tool, with each compartment having a different dimension than the other compartments. In some aspects, the dimensions of the different compartments may increase from a downhole end of the downhole tool 200 toward an uphole end of the downhole tool 200.

As shown, the wellbore system 10 accesses a subterranean formation 40 and provides access to hydrocarbons located in such subterranean formation 40. In an example implementation of system 10, the system 10 may be used for a production operation in which the hydrocarbons may be produced from the subterranean formation 40 within the wellbore tubular 17 (for example, as a production tubing or casing). However, tubular 17 may represent any tubular member positioned in the wellbore 20 such as, for example, coiled tubing, any type of casing, a liner or lining, another downhole tool connected to a work string (in other words, multiple tubulars threaded together), or other form of tubular member.

A drilling assembly (not shown) may be used to form the wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as a surface casing 30 and intermediate casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be submerged under an ocean, gulf, sea, or any other body of water under which hydrocarbon-bearing formations may be found. In short, reference to the terranean surface 12 includes both land and underwater surfaces and contemplates forming and developing one or more wellbore systems 10 from either or both locations.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

As shown, the downhole tool 200 may be run into the wellbore 20 and through the tubular 17 on a downhole conveyance 22. In some aspects, the downhole conveyance 22 can be a tubular conveyance, such as a tubular workstring made up of multiple tubular members. As another example, the tubular conveyance 22 can be coiled tubing. In alternative examples, the downhole conveyance 22 can be a downhole conductor, such as wireline.

In some aspects, as shown, the downhole tool 200 may receive a wellbore fluid 50 that is circulated, for example, through the downhole conveyance 22, and into the downhole tool 200 (as described in more detail later). The wellbore fluid 50 can be circulated at a single or multiple, selectable and adjustable fluid pressures (for example, according to operation of a flow control system, not shown, that includes one or more pumps and one or more valves fluidly coupled to the downhole conveyance 22). In some aspects, the wellbore fluid 50 can be circulated at a particular fluid pressure to activate a portion of the downhole tool 200. In addition, the wellbore fluid 50 can be circulated at another particular fluid pressure to activate another portion of the downhole tool 200. Such activation, in some aspects and as explained in more detail later, can occur sequentially during operation of the downhole tool 200.

Figure 2A:
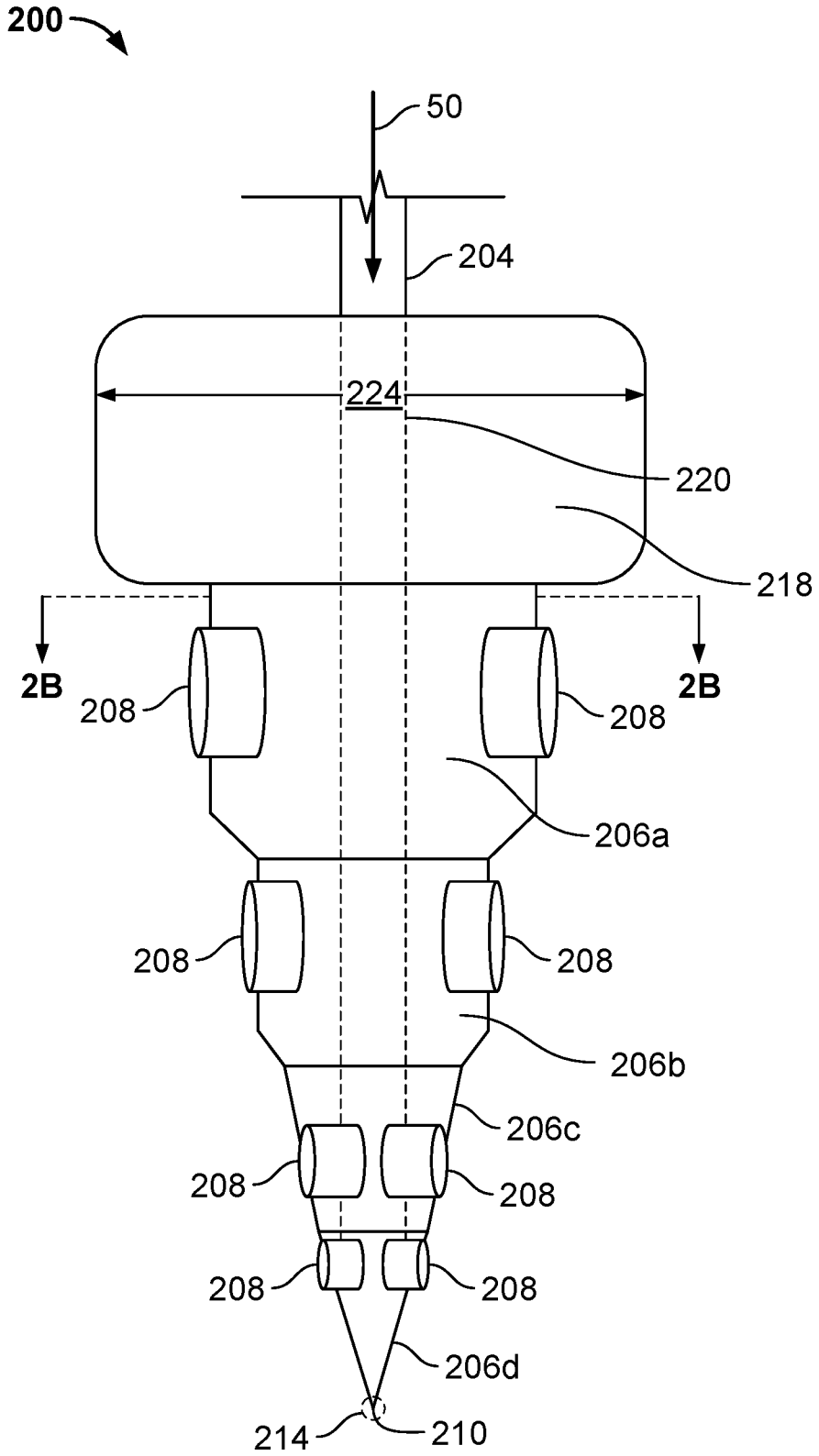
FIGS. 2A and 2B are schematic diagrams that show side and top views, respectively, of a downhole tool according to the present disclosure.
Figure 2B:
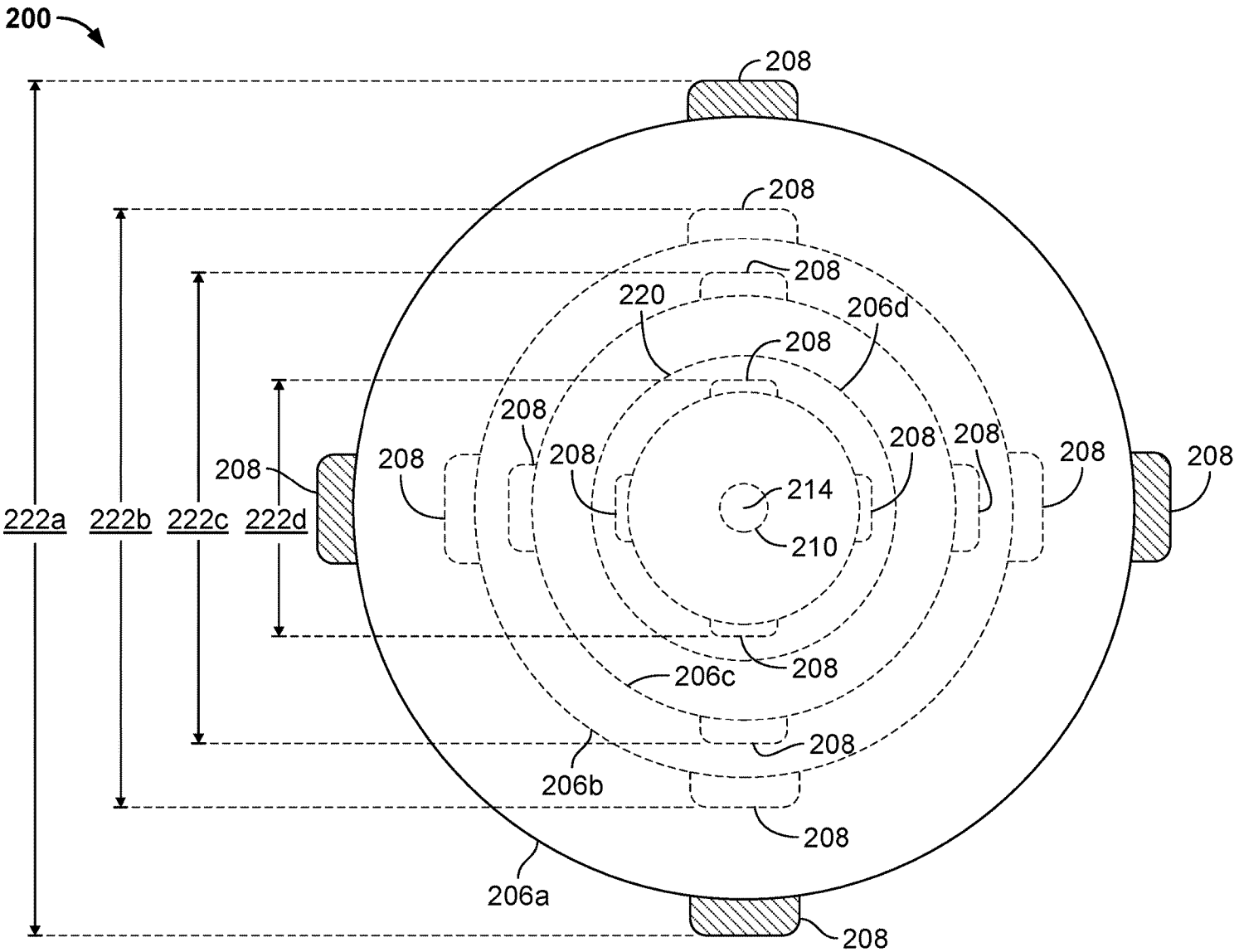

FIGS. 2A and 2B are schematic diagrams that show side and top views, respectively, of downhole tool 200. As shown in FIGS. 2A-2B, downhole tool 200 includes a top sub-assembly 204 that is configured to couple to a downhole conveyance, such as downhole conveyance 22. Coupled to the top sub-assembly 204 (directly or indirectly) is a swage 218. The swage 218, in some aspects, comprises a hydraulic swage that is expandable (for example, based on a pressurized fluid circulated to the downhole tool 200 and to the swage 218) to contact and expand a tubular in a wellbore, such as the tubular 17. In some aspects, expansion of the swage 218 during operation of the downhole tool 200 can expand (or further expand) a collapsed tubular portion (such as tubular portion 60) into the tubular's original cross-sectional shape (for example circular).

Downhole of the swage 218 in the downhole tool 200 are one or more compartments 206*a*-206*d*. In this example implementation of the downhole tool 200, four compartments 206*a*-206*d* are included; other example implementations may include a fewer number or greater number of compartments. Generally, each compartment 206*a*-206*d* includes one or more extendable members 208 that are positioned about an outer surface of the particular compartment 206*a*-206*d*. As shown more clearly in FIG. 2B, four extendable members 208 are positioned at, for example, 90° intervals about a circumferential outer surface of each compartment 206*a*-206*d*. In alternative implementations, however, there can be more or fewer extendable members 208 for each compartment 206*a*-206*d* and can be positioned at different radial intervals about a circumferential outer surface of each compartment 206*a*-206*b*.

In some examples, each extendable member 208 comprises a piston that can be extended, for example, hydraulically, away from the particular compartment 206*a*-206*d* based on circulation of the wellbore fluid 50 through a bore 220 that extends axially through at least a portion of the downhole tool 200. In some aspects, each extendable member 208 positioned within a particular compartment 206*a*-206*d* can be hydraulically activated to extend away from the downhole tool 200 in a simultaneous fashion.

In some aspects, each extendable member 208 can be made of a material that is of a greater specification, for example, hardness or otherwise, relative to the tubular 17. For example, the extendable member 208 can be made of material similar to drill pipe or mills as compared to the material of the tubular 17 to avoid any damaging friction to the downhole tool 200 during its operation. In some aspects, the material and grade of the extendable members 208 can be selected to account for planned activation pressures of the compartments 208*a*-208*d* (that extend the extendable members 208 to contact the tubular 17) such that the activation fluid pressures (by wellbore fluid 5) are less than a burst limitation pressure of the downhole tool 200. In some aspects, the material of the extendable members 208 can be equivalent to that of the downhole conveyance 22 to avoid having the downhole tool 200 as a weak point in case the downhole tool 200 (and conveyance 22) became stuck downhole and over-pull was required to free the downhole tool 200.

As shown in FIGS. 2A-2B, compartment 206*d* is positioned at or near a downhole end of the downhole tool 200 that includes a tapered portion 210. In some aspects, the tapered portion 210 is part of the compartment 206*d*. As shown in this example, the tapered portion 210 includes a pointed end 214. In some aspects, during operation of the downhole tool 200, the downhole tool 200 can be positioned at or near the damaged portion 60 and moved into a small opening or crevice of the damaged portion 60 to, for example, radially center the downhole tool 200 within the damaged portion 60 of the tubular 17.

As further shown in FIGS. 2A, 2B, the swage 218 and respective compartments 206*a*-206*d* can be sized differently to ensure or help ensure correct operation of the downhole tool 200 in opening up, for example, the damaged portion 60 of the tubular 17. For example, compartment 208*d* has an outer dimension (for example, diameter 222*d*), which is less than an outer dimension (for example, diameter 222*c*) of compartment 208*c*, which is less than an outer dimension (for example, diameter 222*b*) of compartment 208*b*, which is less than an outer dimension (for example, diameter 222*a*) of compartment 208*a*. The diameter 222*a*, in this example, is less than an outer dimension (for example, diameter 224) of the swage 218. Thus, in this example implementation of the downhole tool 200, the compartments 208*a*-208*d* become smaller toward a downhole end of the downhole tool 200, and the swage 218 is the largest (for example, circumferentially) component of the downhole tool 200 relative to the compartments 208*a*-208*d*.

Figure 3:
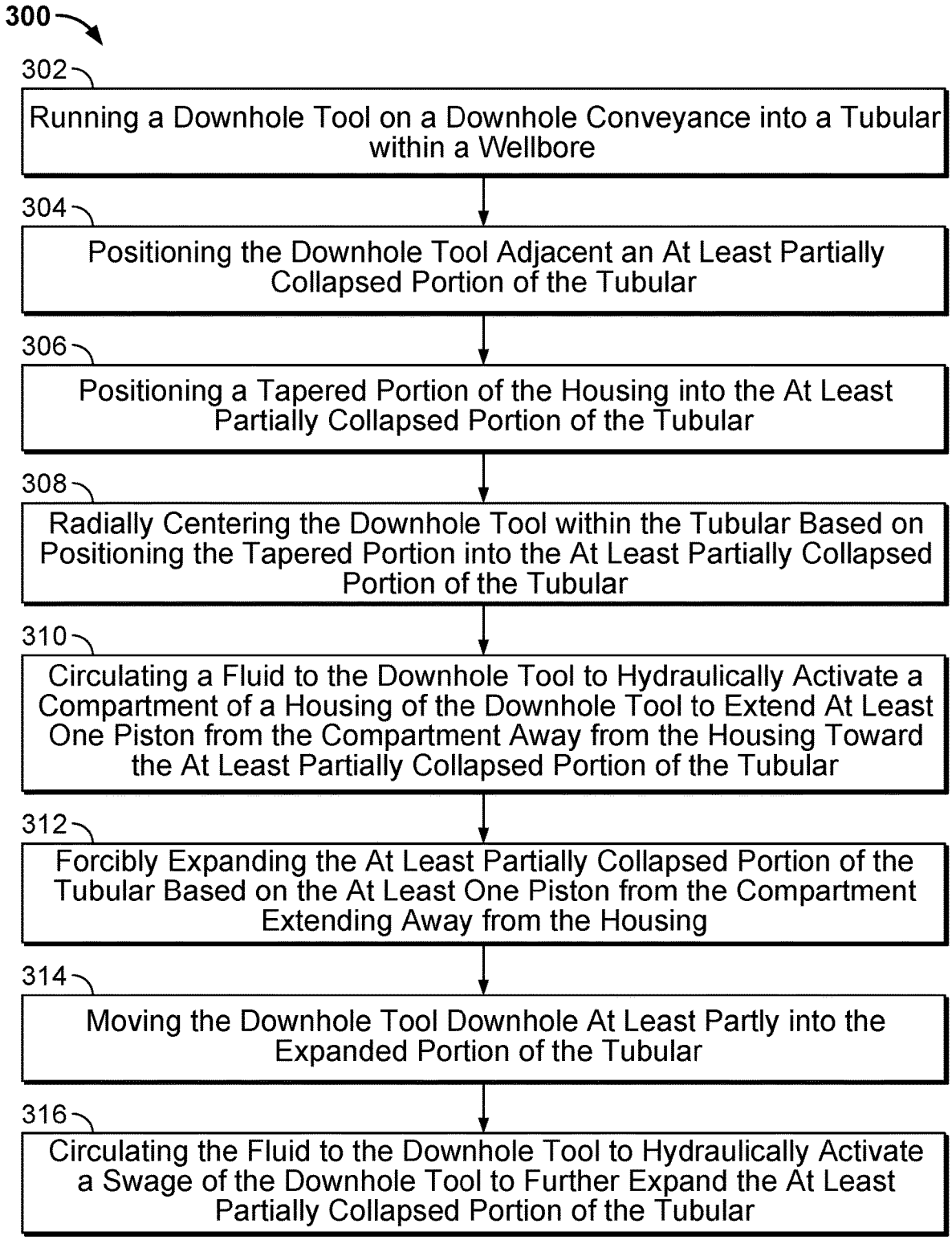
FIG. 3 is a flowchart that illustrates an example operation of a downhole tool according to the present disclosure.

FIG. 3 is a flowchart that illustrates an example method 300 of operation of the downhole tool 200. Method 300 can begin at step 302, which includes running a downhole tool on a downhole conveyance into a tubular within a wellbore. For example, downhole tool 200 can be run into the wellbore 20 on downhole conveyance 22, which can be a tubular work string or other conveyance. The downhole tool 200 can be run into the tubular 17, which can be a production tubing, a casing, or other downhole tubular installed or positioned in the wellbore 20 (such as a wellbore liner).

Method 300 can continue at step 304, which includes positioning the downhole tool adjacent an at least partially collapsed portion of the tubular. For example, as shown in FIG. 1, the tubular 17 can have a damaged portion 60 that comprises a pinched or otherwise closed portion of the tubular 17 that, for example, would not allow a tool, work string, or even fluid, to pass through the tubular 17 downhole of the damaged portion 60.

Method 300 can continue at step 306, which includes positioning a tapered portion of the housing into the at least partially collapsed portion of the tubular. For example, turning to FIG. 4A briefly, this figure shows downhole tool 200 positioned in the tubular 17 and near the damaged portion 60. As shown in this figure, the tapered portion 210 is positioned at the damaged portion 60 such that, for example, the pointed end 214 is inserted into a crevice or small opening of the damaged portion 60.

Figure 4A:
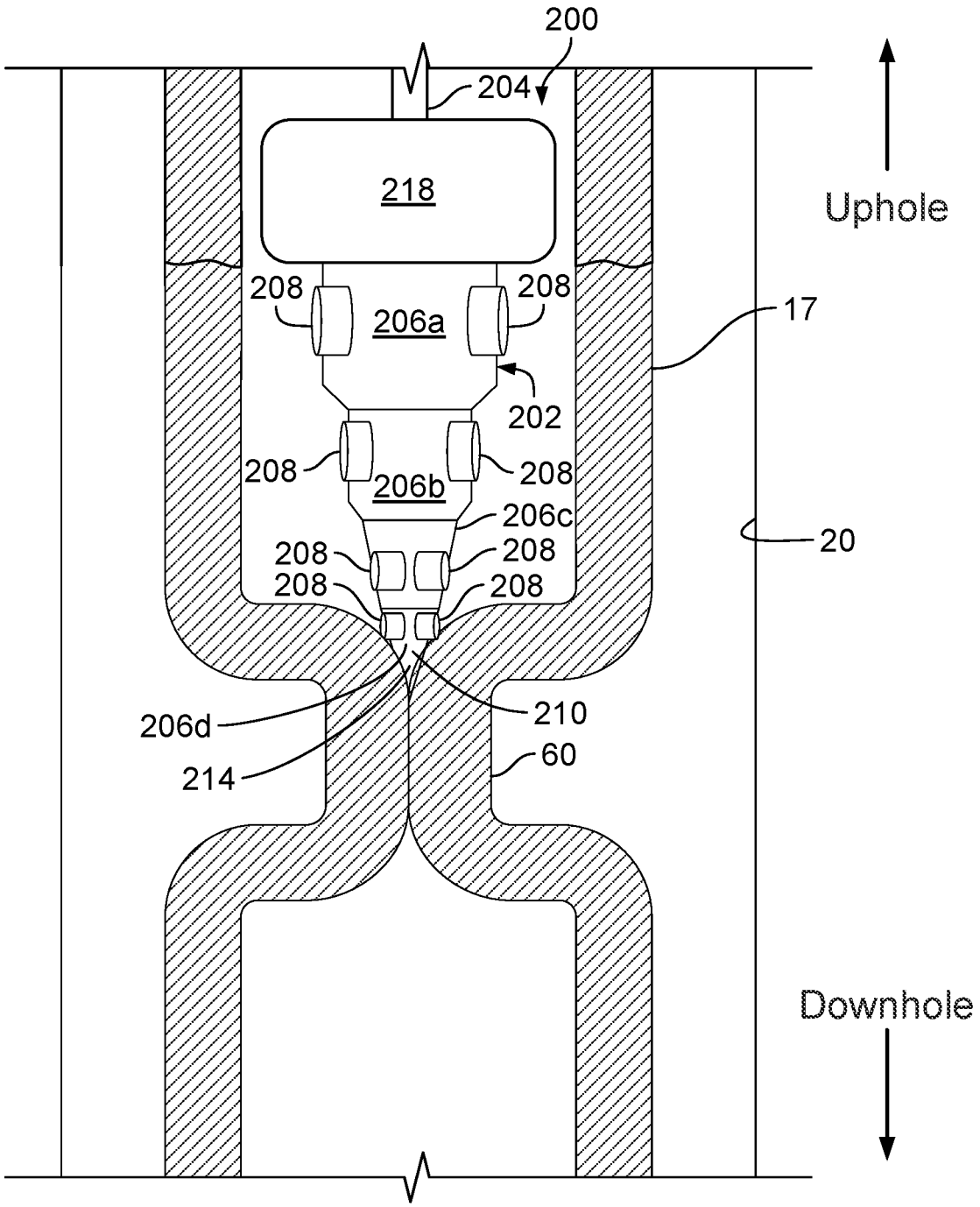
FIGS. 4A-4D are schematic diagrams of a downhole tool during a downhole operation according to the present disclosure.

Method 300 can continue at step 308, which includes radially centering the downhole tool within the tubular based on positioning the tapered portion into the at least partially collapsed portion of the tubular. For example, as shown in FIG. 4A, once the tapered portion 210 is positioned in the damaged portion 60, the downhole tool 200 is radially centered (or close to radially centered) within the tubular 17 or, in some cases, within the damaged portion 60 of the tubular 17.

Method 300 can continue at step 310, which includes circulating a fluid to the downhole tool to hydraulically activate a compartment of a housing of the downhole tool to extend at least one piston from the compartment away from the housing toward the at least partially collapsed portion of the tubular. For example, turning to FIG. 4B, this figure shows activation of compartment 206*d* to extend the extendable members 208 into contact with the damaged portion 60 of the tubular 17.

The extendable members 208 of compartment 206*d* can be extended by a particular fluid pressure of the wellbore fluid 50 that is circulated to the downhole tool 200 through the downhole conveyance 22 (and through the bore 220). For example, in an example operation to activate compartment 206*d* (or other compartments of the downhole tool 200), the extendable members 208 of compartment 206*d* (or another particular compartment) can be pre-set to active (extend) based on a particular fluid pressure of the wellbore fluid 50. In the case of a downhole tool 200 with multiple compartments, such as compartments 206*a*-206*d*, each compartment can be configured to activate at a different fluid pressure (with the downhole-most compartment 206*d* requiring the highest pressure, the uphole-most compartment 206*a* requiring the lowest pressure, and the compartments 208*b*-208*c* there between requiring intermediate pressures. In some aspects, a particular compartment of the downhole tool 200, such as the compartment 206*d*, can be activated by setting a ball through the downhole conveyance 22 to seat in the downhole tool 200 before pressuring up the fluid pressure of the wellbore fluid 50 to activate the compartment 206*d*.

Figure 4B:
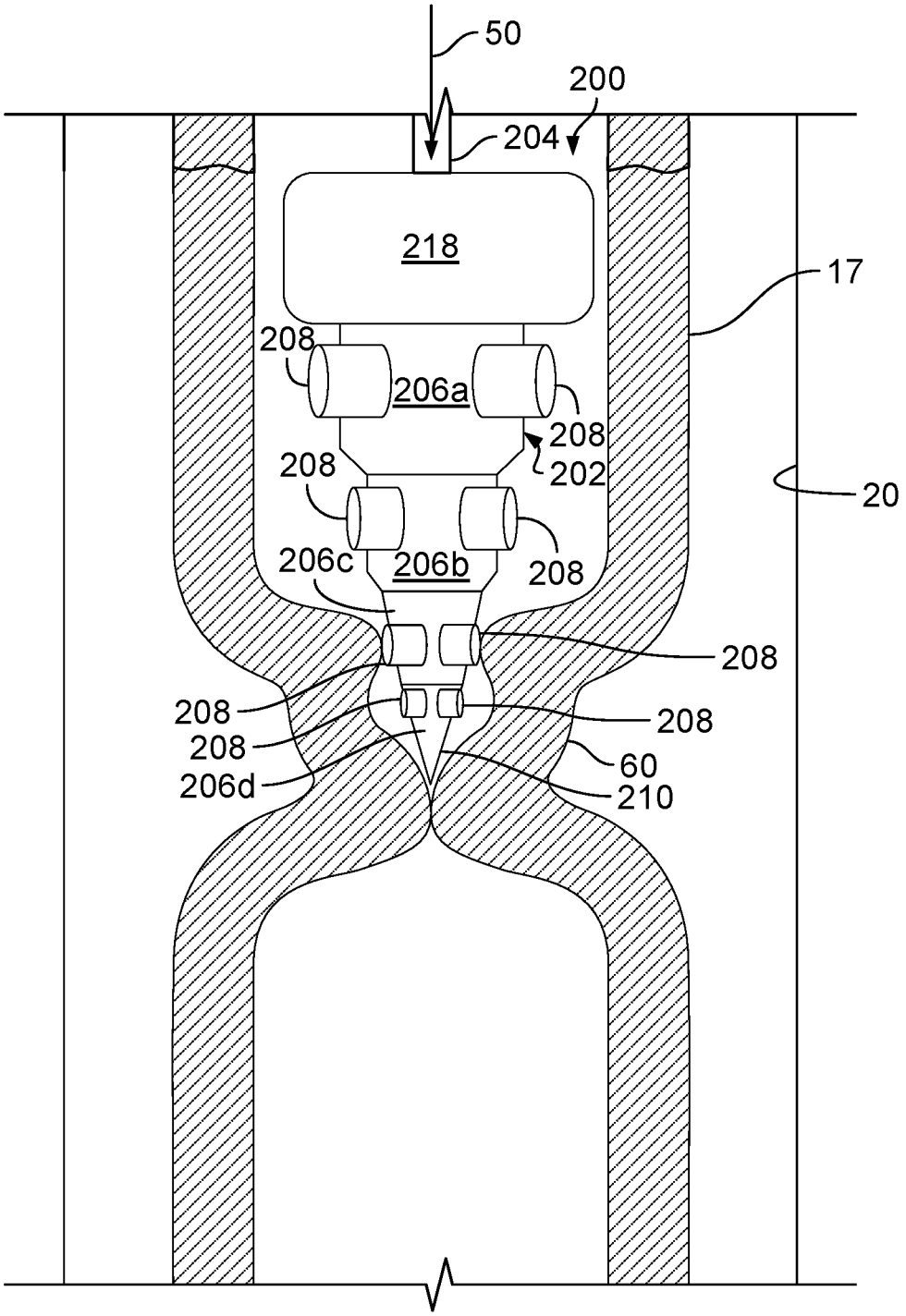

Method 300 can continue at step 312, which includes forcibly expanding the at least partially collapsed portion of the tubular based on the at least one piston from the compartment extending away from the housing. For example, as the extendable members 208 of compartment 206*d* are activated, they contact and force open at least a section of the damaged portion 60 of the tubular 17 (as shown in FIG. 4B).

Method 300 can continue at step 314, which includes moving the downhole tool downhole at least partly into the expanded portion of the tubular. For example, as compartment 206*d* is activated to force a section of the damaged portion 60 of the tubular 17 open, the downhole tool 200 can be moved downhole on the downhole conveyance 22 to urge the downhole tool 200 into the section of the damaged portion 60 that has been forced open.

Figure 4C:
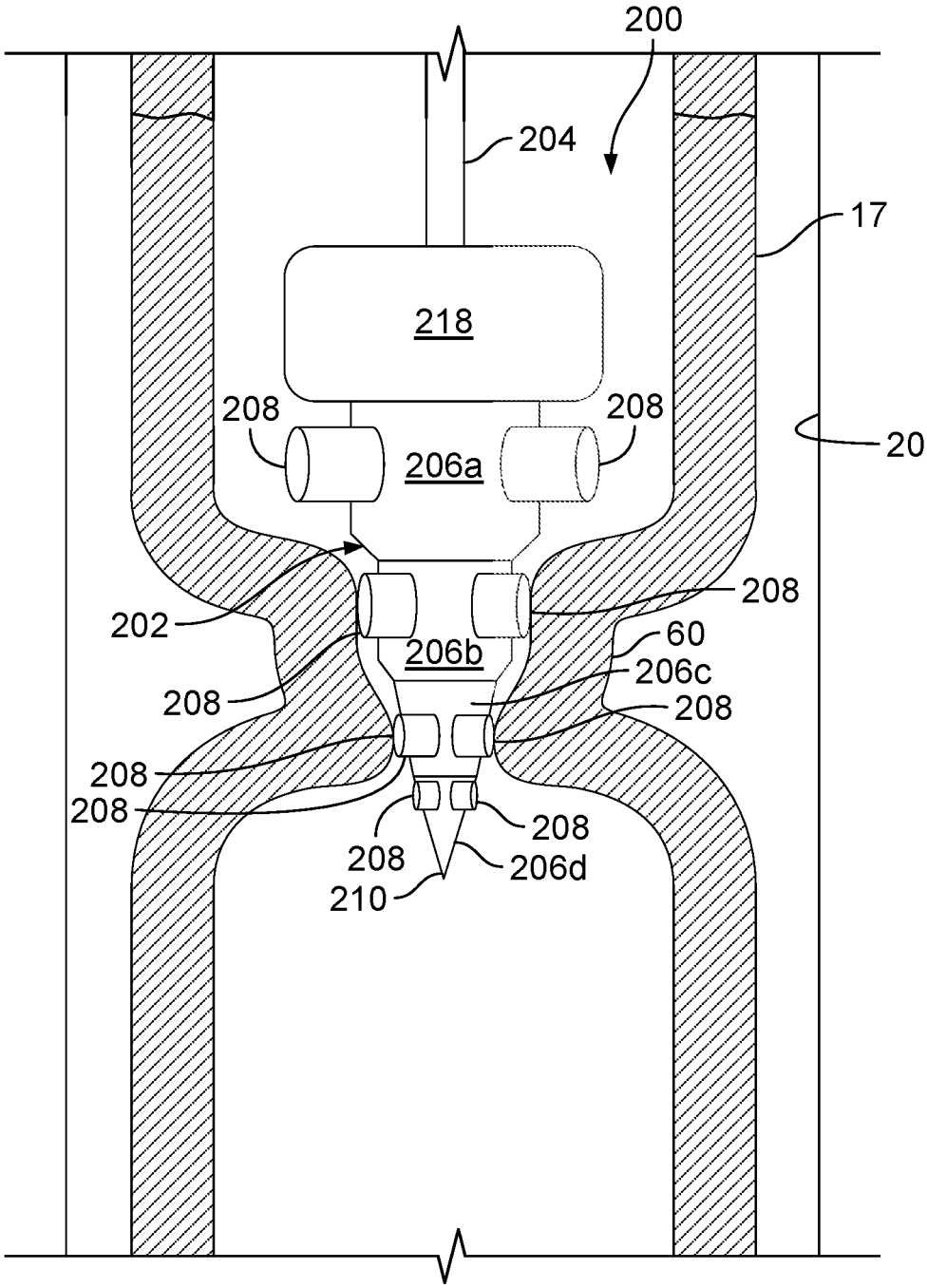

Steps 312 and 314 can be repeated as necessary with each repetition of step 312 activating a different (and larger) compartment 206*c*-206*a* of the downhole tool 200. For example, turning to FIG. 4C, this figure shows activation of compartment 206*c* to extend the extendable members 208 of this compartment into contact with the damaged portion 60, that has now been forcibly opened by the activation of compartment 206*d*. The extendable members 208 of compartment 206*c* can be extended by another particular fluid pressure of the wellbore fluid 50 (different than that used to activate compartment 206*d*) that is circulated to the downhole tool 200 through the downhole conveyance 22 (and through the bore 220). Activation of compartment 206*c* can occur similar to the activation operation of compartment 206*d*. Thus, after activation of compartment 206*c*, the damaged portion 60 can further forcibly expand the at least partially collapsed portion of the tubular 17.

Activation of compartment 206*b* to extend the extendable members 208 of this compartment into contact with the damaged portion 60, that has now been forcibly opened by the activation of compartment 206*c*, can occur sequentially after the activation of compartment 206*c*. The extendable members 208 of compartment 206*b* can be extended by another particular fluid pressure of the wellbore fluid 50 (different than that used to activate compartments 206*c*-

206*d*) that is circulated to the downhole tool 200 through the downhole conveyance 22 (and through the bore 220). Activation of compartment 206*b* can occur similar to the activation operation of compartment 206*c*-206*d*. Thus, after activation of compartment 206*b*, the damaged portion 60 can further forcibly expand the at least partially collapsed portion of the tubular 17.

Activation of compartment 206*a* to extend the extendable members 208 of this compartment into contact with the damaged portion 60, that has now been forcibly opened by the activation of compartments 206*b*-206*d*, can occur sequentially after the activation of compartment 206*b*. The extendable members 208 of compartment 206*a* can be extended by another particular fluid pressure of the wellbore fluid 50 (different than that used to activate compartments 206*b*-206*d*) that is circulated to the downhole tool 200 through the downhole conveyance 22 (and through the bore 220). Activation of compartment 206*a* can occur similar to the activation operation of compartment 206*b*-206*d*. Thus, after activation of compartment 206*a*, the damaged portion 60 can further forcibly expand the at least partially collapsed portion of the tubular 17.

Figure 4D:
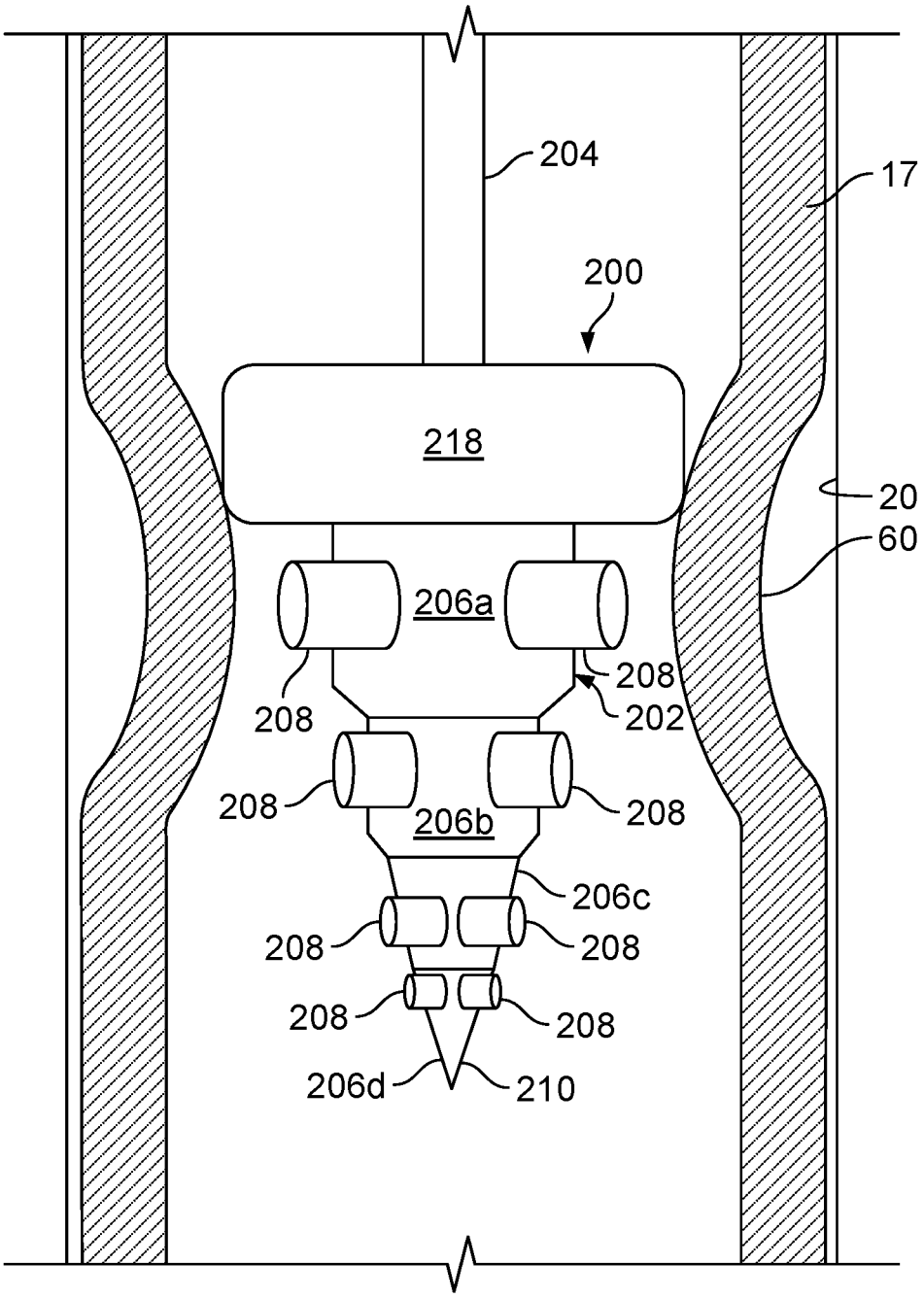

Method 300 can continue at step 316, which includes circulating the fluid to the downhole tool to hydraulically activate a swage of the downhole tool to further expand the at least partially collapsed portion of the tubular. For example, turning to FIG. 4D, the swage 218 can be hydraulically activated by a particular fluid pressure of the wellbore fluid 50 to expand and further forcibly expand the damaged portion 60 of the tubular 17. In some aspects, a size of the swage 218, such as a circumference of the swage 218 in an expanded position as shown in FIG. 4D, can be selected to match or substantially match an original cross-section area of the tubular 17. Further, in some aspects, once the swage 218 is activated and expanded, the downhole tool 200 can be moved downhole through the damaged portion 60 such that the activated swage 218 expands the damaged portion 60 to the full cross-section (or close to the full cross-section) of the tubular 17.

Method 300 can include other steps as well. For example, in some aspects, prior to step 302 (prior to running the downhole tool 200 into the wellbore 20), a heated fluid can be circulated into the wellbore 20 and to the damaged portion 60 of the tubular 17. The heated fluid (for example, liquid, steam, or other fluid) can relax the material of the damaged portion 60 to allow for easier or more efficient expansion by the extendable members 208 and the swage 218.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole tool, comprising:

a top sub-assembly configured to couple to a downhole conveyance;

a housing coupled to the top sub-assembly at an uphole end of the housing, the housing comprising:

a bore that extends through the housing from at least near the top sub-assembly to a downhole end of the housing opposite the uphole end, the downhole end of the housing comprising a tapered portion; and a plurality of compartments fluidly coupled to the bore, at least one of the plurality of compartments comprising at least one piston configured to extend away from the housing to forcibly expand at least a portion of a wellbore tubular based at least in part on a fluid pressure in the at least one compartment; and at least one hydraulic swage coupled to the housing and configured to expand to forcibly expand at least the portion of the wellbore tubular based at least in part on a fluid pressure in the bore.

2. The downhole tool of claim 1, wherein the plurality of compartments comprise a first compartment positioned adjacent the tapered portion and a second compartment positioned between the first compartment and the top sub-assembly.

3. The downhole tool of claim 2, wherein the first compartment comprises a first external dimension and the second compartment comprises a second external dimension larger than the first external dimension.

4. The downhole tool of claim 3, wherein the first and second external dimensions are diameters.

5. The downhole tool of claim 3, wherein the at least one hydraulic swage is coupled to the housing between the second compartment and the top sub-assembly, the at least one hydraulic swage comprising an unexpanded dimension larger than the second external dimension.

6. The downhole tool of claim 3, wherein the plurality of compartment further comprises a third compartment positioned between the second compartment and the top sub-assembly, the third compartment comprising a third external dimension larger than the second external dimension.

7. The downhole tool of claim 6, wherein the at least one hydraulic swage is coupled to the housing between the third compartment and the top sub-assembly, the at least one hydraulic swage comprising an unexpanded dimension larger than the third external dimension.

8. The downhole tool of claim 1, wherein each of the plurality of compartments comprises at least one piston configured to extend away from the housing based at least in part on the fluid pressure in the at least one compartment.

9. The downhole tool of claim 1, wherein the at least one piston comprises a plurality of pistons positioned about an external perimeter of the at least one compartment.

10. A method for expanding a wellbore tubular, comprising:

running a downhole tool on a downhole conveyance into a tubular within a wellbore, the downhole conveyance coupled to a top sub-assembly of the downhole tool;

positioning the downhole tool adjacent an at least partially collapsed portion of the tubular within the wellbore;

circulating a fluid to the downhole tool to hydraulically activate a compartment of a housing of the downhole tool to extend at least one piston from the compartment away from the housing toward the at least partially collapsed portion of the tubular;

based on the at least one piston from the compartment extending away from the housing, forcibly expanding the at least partially collapsed portion of the tubular;

moving the downhole tool downhole at least partly into the expanded portion of the tubular; and circulating the fluid to the downhole tool to hydraulically activate a swage of the downhole tool to further expand the at least partially collapsed portion of the tubular.

11. The method of claim 10, wherein the compartment comprises a first compartment, the method further comprising:

subsequent to forcibly expanding the at least partially collapsed portion of the tubular with the at least one piston of the first compartment, moving the downhole tool downhole at least partly into the expanded portion of the tubular;

circulating the fluid to the downhole tool to hydraulically activate a second compartment of the housing of the downhole tool to extend at least one piston from the second compartment away from the housing toward the at least partially collapsed portion of the tubular; and based on the at least one piston from the second compartment extending away from the housing, further forcibly expanding the at least partially collapsed portion of the tubular.

12. The method of claim 11, wherein the first compartment comprises a first external dimension and the second compartment comprises a second external dimension larger than the first external dimension.

13. The method of claim 12, wherein circulating the fluid to the downhole tool to hydraulically activate the swage of the downhole tool further expand the at least partially collapsed portion of the tubular occurs subsequent to further forcibly expanding the at least partially collapsed portion of the tubular with the at least one piston of the second compartment.

14. The method of claim 12, further comprising:

subsequent to further forcibly expanding the at least partially collapsed portion of the tubular with the at least one piston of the second compartment, moving the downhole tool downhole further into the expanded portion of the tubular;

circulating the fluid to the downhole tool to hydraulically activate a third compartment of the housing of the downhole tool to extend at least one piston from the third compartment away from the housing toward the at least partially collapsed portion of the tubular; and based on the at least one piston from the third compartment extending away from the housing, further forcibly expanding the at least partially collapsed portion of the tubular.

15. The method of claim 14, wherein circulating the fluid to the downhole tool to hydraulically activate the swage of the downhole tool further expand the at least partially collapsed portion of the tubular occurs subsequent to further forcibly expanding the at least partially collapsed portion of the tubular with the at least one piston of the third compartment.

16. The method of claim 10, wherein positioning the downhole tool adjacent the at least partially collapsed portion of the tubular within the wellbore comprises:

positioning a tapered portion of the housing into the at least partially collapsed portion of the tubular within the wellbore; and based on the positioning, at least partially radially centering the downhole tool within the tubular.

17. The method of claim 10, wherein extending the at least one piston from the compartment away from the housing toward the at least partially collapsed portion of the tubular comprises extending a plurality of pistons positioned around a perimeter of the compartment away from the housing toward the at least partially collapsed portion of the tubular.

18. The method of claim 10, wherein further expanding the at least partially collapsed portion of the tubular with the hydraulically activated swage comprises smoothing or flattening the at least partially collapsed portion of the tubular.

19. The method of claim 10, further comprising circulating a heated fluid to the at least partially collapsed portion of the tubular within the wellbore prior to or concurrently with running the downhole tool on the downhole conveyance into the tubular within the wellbore.

20. A wellbore tubular expansion system, comprising:

a segmented body that comprises a fluid pathway that extends along a centerline of the body from a first end of the body towards a second end of the body, the fluid pathway configured to fluidly coupled to a wellbore conveyance, the segmented body comprising a plurality of fluidly coupled segments, each of the fluidly coupled segments having at least one member configured to move away from the centerline of the body in response to a first increase in fluid pressure in the fluid pathway to deform a wellbore tubular;

a swage attached to or formed with the segmented body and fluidly coupled with the fluid pathway, the swage configured to expand in response to the first increase or a second increase in fluid pressure in the fluid pathway to deform the wellbore tubular; and a conical member affixed at the second end of the body.

21. The wellbore tubular expansion system of claim 20, wherein the plurality of fluidly coupled segments are fluidly coupled together through the fluid pathway.

22. The wellbore tubular expansion system of claim 20, wherein the at least one member comprises at least one piston configured to move away from the centerline of the body in response to the first increase in fluid pressure in the fluid pathway to deform the wellbore tubular.

* * * * *